United States Patent [19]

Prather

[11] 4,214,347

[45] Jul. 29, 1980

[54] METHOD AND APPARATUS OF FEEDING COTTON TO A GIN

[76] Inventor: Jimmy F. Prather, P.O. Box 629, Brownfield, Tex. 79316

[21] Appl. No.: 33,112

[22] Filed: Apr. 25, 1979

[51] Int. Cl.[2] ..... D01G 7/00

[52] U.S. Cl. ..... 19/64.5; 19/80 R; 241/101.7

[58] Field of Search ..... 19/80 R, 64.5; 241/101.7

[56] References Cited

U.S. PATENT DOCUMENTS

| | | | |
|---|---|---|---|
| 4,109,875 | 8/1978 | Condarco et al. | 19/80 R |
| 4,117,571 | 10/1978 | Prather | 19/64.5 |

*Primary Examiner*—Louis Rimrodt
*Attorney, Agent, or Firm*—Wendell Coffee

[57] ABSTRACT

A door is mounted about a vertical axis on the door jambs of a module feeder which is for feeding seed cotton to a cotton gin. The door is mounted to the jambs by a false door. As the end of the module is approached, the false doors are swung shut pushing the doors against the end of the module. After the false doors are swung shut, the bottom of the doors are pushed against the bottom of the module to push the cotton into the feeder drums, the feeder drums being angled so that the top is more advanced against the module then the bottom.

10 Claims, 4 Drawing Figures

METHOD AND APPARATUS OF FEEDING COTTON TO A GIN

BACKGROUND OF THE INVENTION (1) Field of the Invention

This invention relates to cotton harvesting and more particularly to feeding harvested seed cotton into cotton gins.

(2) Description of the Prior Art

CONDARCO ET AL., U.S. Pat. No. 4,109,875, discloses a module feeding apparatus which has a back up door which is hinged to the top member of the module feeder. As the end of the module is approached, the door is pivoted down from its top position to press against or back up the remnant of the module as it is being fed. In this regard, CONDARCO ET AL. also referred to their door as a back up member.

My prior U.S. Pat. No. 4,117,571 also discloses a module feeder with a door which is hinged at the top. This door also acts as a back up member against the remnant and in addition, it has a panel which is spring supported but which rides along the slab to push the remnant against the bottom of the feeder drums.

SUMMARY OF THE INVENTION (1) New and Different Function

I have invented a different way of pushing the remnant of the module against the feeder drums. The doors are hung on false doors. The false doors are hinged to the vertical door jambs along the sides. Therefore, the individual doors act as wings to extend along either side of the module while it is being fed. Also, the doors are not suspended overhead in such a manner as they could collapse and fall in the event of a hydraulic failure or a mechanical failure of the suspension system. After the false doors have been swung shut about the door jambs, the door which is hung on the false door is pushed against the remnant. The top of the door is restrained by the door head at the top of the doorway but the bottom is free to move against the module. Therefore, the door conforms to the angle of the feeder drums. Also, the door is hung in such a way that it moves downward against the slab as it is pushed against the remnant.

Thus, it may be seen that the function of the total combination far exceeds the sum of the functions of the individual elements, such as door jambs, hinges, etc.

(2) Objects of this Invention

An object of this invention is to feed seed cotton from a module into a cotton gin.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following descripton and from the accompanying drawing, the different views of which are not scale drawings.

DESCRIPTION OF THE PREFERRED EMBODIMENT

Figure 1:
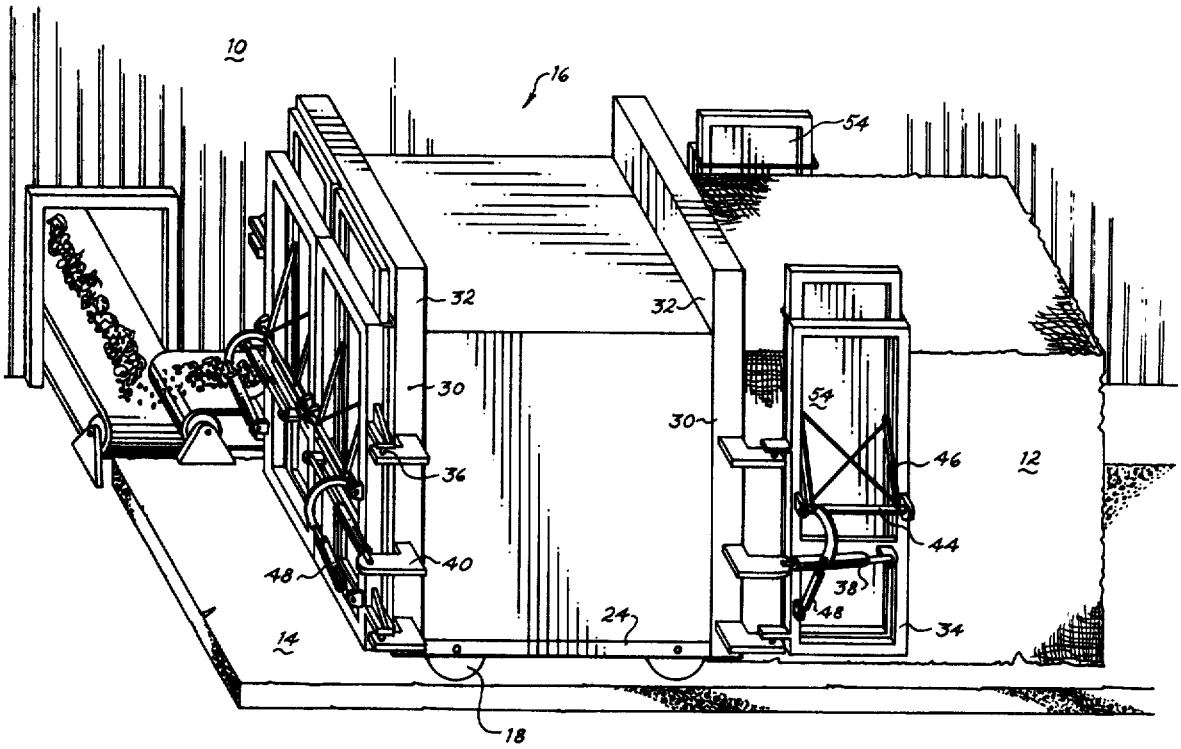
FIG. 1 is a perspective view of an embodiment of this invention with the doors on one end in the closed end position and the doors on the other end in the open wing position.
Figure 2:
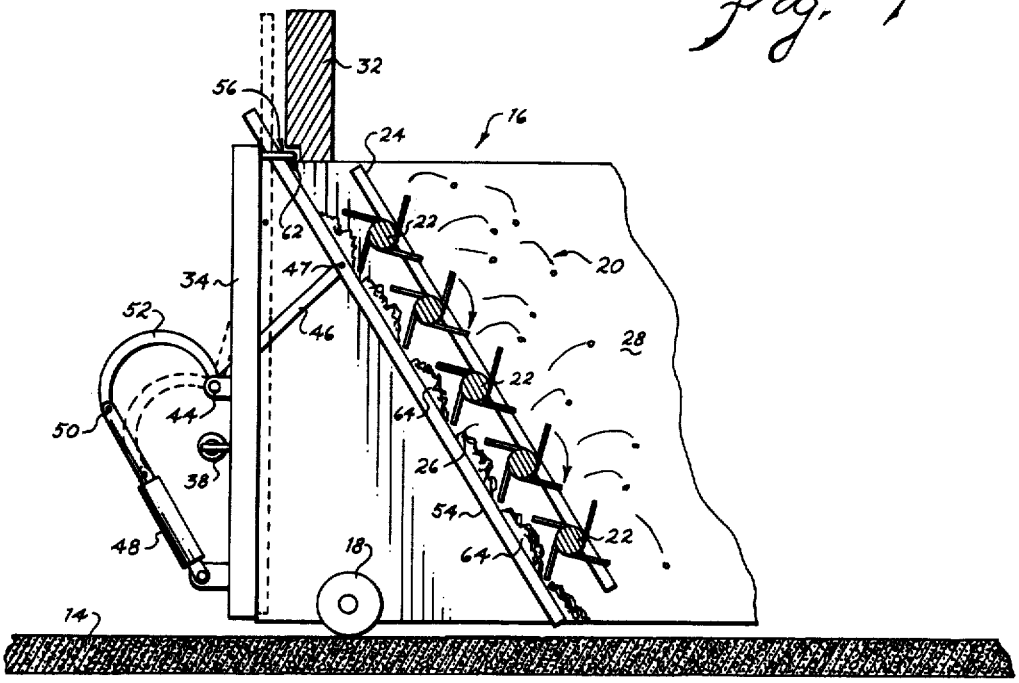
FIG. 2 is a sectional partial view taken on a longitudinal line through the feeder substantially along line 2—2 of FIG. 3 with the door shown feeding the last of the remnant to the feeder means.
Figure 3:
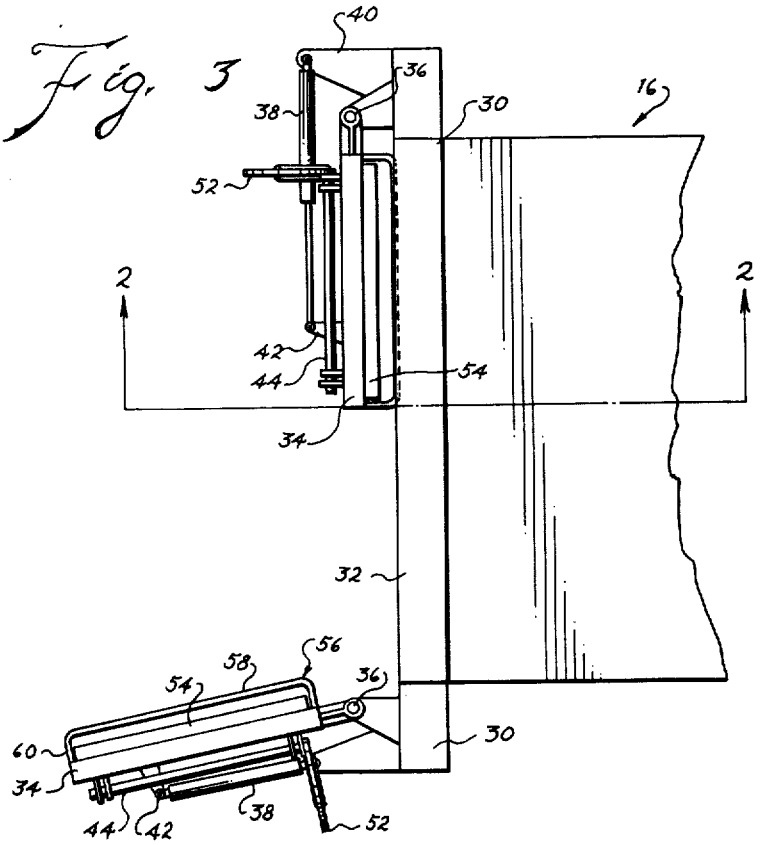
FIG. 3 is a top plan partial view of the feeder with one of the doors shown in the closed end position and the other in the open wing position.
Figure 4:
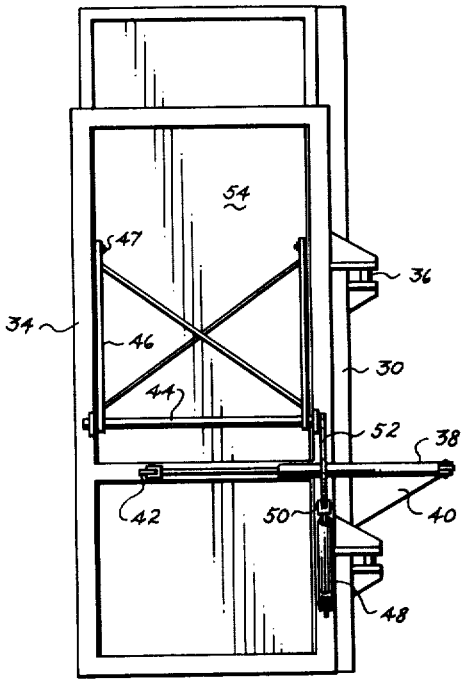
FIG. 4 is a front elevational partial view of the end of the feeder with one of the doors in the closed position.

Referring to the drawings, there may be seen somewhat schematically represented cotton gin 10 which will process the seed cotton from module 12 setting upon concrete slab 14. The cotton is removed from the module 12 by the module feeder 16 which is mounted upon wheels 18 so that it can be reciprocated along the slab to move against the module. Specifically, the seed cotton in the module is loosened and removed from the module or released from the module by feeder means 20. The feeder means 20 is in the form of a series of feeder drums 22 which are mounted upon frame 24 of the module 16 at an angle. Specifically, the feeder means are bank of drums 22 have a module side 26 and a feeder side 28. The top drum is toward the module side 26 and the bottom drum is toward the feeder side 28. I.e., the feeder means is arranged so that as it feeds cotton from the module, the cotton is sloped back from the bottom to the top. Inasmuch as the drive for rotating the feeder drums 22 form no part of this invention and also drives are well shown in my previous U.S. Pat. No. 4,117,571 and in CONDARCO ET AL.'s U.S. Pat. No. 4,109,875, they will not be further described here. Also, the drive means for the wheels 18 which are a portion of the reciprocating means on the frame for moving the frame toward and away from a module are not shown since they would be within the skill and also they have been disclosed in the patents indicated above. The frame 24 will have a doorway formed by door jambs 30, one door jamb being on either side of the doorway, which is the side of the frame. Also, the top of the doorway will be defined by door head 32 which extends between the door jambs at the top thereof.

A study of the two patents above will indicate that the invention described to this point was known before the filing of this application.

To this module feeder, I have hinged false door 34 to each of the door jambs 30. The false door is a rectangular structure or framework made of tubular material. It is attached to the door jambs by hinges 36. The hinges are vertical. I.e., the false door will swing about the door jambs, which are vertical, along a vertical axis through the hinges 36. The doors are swung either open or closed by swing means in the form of swing hydraulic cylinders 38. One end of the hydraulic cylinder is attached to brace 40 on the door jamb and the ram of the cylinder is attached to ear 42 upon the false door. The hydraulic pumps, lines controlling the hydraulic cylinders have not been shown inasmuch as those having ordinary skill in the art will understand how to connect the hydraulic cylinders through suitable hoses, valves and the like to a source of hydraulic pressure, namely a pump.

Therefore, it will be understood that this swing means as described connects the false door 34 to the jamb 30 for the purpose of opening and closing the false doors. When the false doors are open, they will extend as wings or almost as guides to direct any seed cotton, lying upon concrete slab 14, into the module feeder 16.

Door elevator includes horizontal shaft 44 extending between suitable bearings on the outside of the false door 34. Two cranks 46 extend upward from the shaft. The top of the cranks have pins through them which form upper pivot 47. It may be seen that the elevator is pivoted to the false door 34 about an horizontal axis and the axis of the upper pivots are also horizontal. The elevator means includes elevator hydraulic cylinder 48 which has its bottom portion pinned to a suitable brace on the lower part of the false door 34 and the ram of the hydraulic cylinder 48 is pivoted at 50 to elevator arm 52.

Door 54 is hung by the upper pivot 47. The door is solid or a slab specifically a frame cover with sheet metal. The door in the retracted position extends through guide 56 in the form of a slot at the top of the false door 34. Specifically, the guide includes pipe 58 spaced toward the door head from the false door 34 and held in that position by supports 60. When the false doors are closed, the pipe 58 will be against the door head above round member 62 on the door head 32.

Analysis will show that when the door 54 is in the retracted position, it is held flush or flat against the false door 34 which is to say that the door will be in a vertical position as is the false door. Then, by the operation of the elevator means, and specifically, by the extension of the elevator hydraulic cylinder 48, the door elevator will move into the module feeder and down. The top of the door is restrained by the round member 62 upon the door head 32 so that it does not move into the feeder. However, the bottom of the door being free will move into the feeder and downward, pushing the cotton and the remnant 64 into the feeder means 20, i.e., into the bank of the feeder drums 22.

Contraction of the elevator hydraulic cylinder 48 will remove the door 54 from the feeder means and bring it back to a flush position on the false door 34. Opening of the false door will also swing the door 54 outward to the wing position.

I have had good success using a door about 12' high with the upper pivot 47 mounted about 7⅜' from the bottom of the door. The false door has the guide 56 about 10¼' from above the bottom of the false door, which itself is about ¼' above the slab. I have found having crank arms 46 about 3⅛' long functions well. The door head is about 10¼' above the bottom of the false door, which is to say that it is about 10½' above the concrete slab.

It will be seen that this construction results in the door being angled at the same angle as the feeder means 20 are angled, i.e., at the same angle as the bank of feeder drums. Therefore, the door 54 is at the same angle as the bank of feeder drums. Therefore, the last of the cotton module, which is called the remnant 64 of the cotton, is pushed against the feeder drums.

Reviewing again the operation of the device, a module 12 of seed cotton is placed upon the 14 slab and then the module feeder 16 is advanced against the module of seed cotton, taking seed cotton from the module. The doors 54 are opened, forming wings along the sides of the module. Then as the end of the module is approached, the doors are swung closed about the vertical door jambs 30 and they are closed when in position upon the feeder module. Using two doors having a width of only one-half the width of the module feeders results only a limited amount of space to be left between the modules when they are placed on the slab. Once the false doors 34 are closed then the bottom of the door 54 is pushed against the module while the top of the door is held in the same position relative to the feeder. Then the bottom of the door is continually pushed inward until the door is adjacent to the feeder means 20 and has about the same angle as the feeder means from top to bottom. Also, it may be seen that the door elevator causes the bottom of the door to be moved downward and moved inward so that when it achieves the angle the bottom of the door is close to the slab.

It will be understood that the preferred form of the feeder will have two doorways, one on each end and, therefore, there will be two sets of back up doors, one on each end.

As an aid to correlating the terms of the claims to the exemplary drawing, the following catalog of elements is provided:

| | |
|---|---|
| 10 cotton gin | 40 brace |
| 12 modules | 42 ear |
| 14 concrete slab | 44 horizontal shaft |
| 16 module feeder | 46 crank |
| 18 wheels | 47 upper pivot |
| 20 feeder means | 48 elevator hydraulic cylinder |
| 22 feeder drums | 50 cylinder pivot |
| 24 frame | 52 elevator arm |
| 26 module side | 54 door |
| 28 feeder side | 56 guide |
| 30 door jamb | 58 pipe |
| 32 door head | 60 supports |
| 34 false door | 62 round members |
| 36 hinges | 64 remnant |
| 38 swing hydraulic cylinders | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In the process of feeding seed cotton to a cotton gin including:

a. placing a module of seed cotton on a slab, b. advancing a module feeder against the module of seed cotton, thereby c. taking the seed cotton from the module; the improved method of supporting and backing up the last portion or remnant of the module as it is being fed into the feeder comprising the following steps:

d. swinging a door about a vertical axis on a door jamb on either side of the module feeder from a wing open position on the module feeder into a closed end position upon the module feeder as soon as the doors may be swung about the end of the module, then after the doors are closed e. pushing the bottom of the door against the module while holding the top of the door in the same position relative to the feeder, and f. continuing to push the bottom door inward until the door is adjacent to feeder means within the feeder and has about the same angle as the feeder means from top to bottom.

2. The invention as defined in claim 1 further comprising:

g. moving the bottom of the door downward toward the slab as it is moved inward into the module feeder.

3. In a module feeder for feeding a module of seed cotton to a cotton gin having a. a frame, b. reciprocating means on the frame for moving the frame toward and away from a module on a slab, c. feeder means on the frame for loosening and removing the seed cotton from the module into the feeder wherein the loosened seed cotton is transported to the gin, d. said feeder means having (i) a module side, and (ii) a feeder side, and e. said feeder means angled so that the top is toward the module side and the bottom is toward the feeder side, f. a doorway on the frame at the module side of the feeder means formed by (i) door jambs extending upward along the sides of the frame, and (ii) a door head extending between the door jambs at the top thereof;

the improved door system comprising in combination with the above:

g. a false door hinged to one of the door jambs, h. swing means connecting the false door to the jamb for opening and closing the false door, j. a door elevator on each false door (i) pivoted about a horizontal axis to the false door, and (ii) extending upward to an upper pivot also on a horizontal axis, k. a door hung on the upper pivot, m. the door extending above the door head, n. elevator means on the false door and door elevator for moving the upper pivots into the feeder and downward so that the door is positioned upon an angle from near the slab in the feeder to the door head.

4. The invention as defined in claim 3 further comprising:

o. said door elevators are in the form of cranks attached to a horizontal shaft upon the false door.

5. The invention as defined in claim 4 further comprising:

p. said elevator means being in the form of a hydraulic cylinder mounted upon the false door to rotate said shaft.

6. The invention as defined in claim 3 further comprising:

o. a door guide in the form of a slot mounted upon the false door which is adjacent to said door head when the false door is closed, p. said door extending through said door guide.

7. The invention as defined in claim 3 further comprising:

o. said elevator means also forming means to move the door at an angle which is approximately the same as the feeder means are angled and the door adjacent to the feeder means from bottom to top.

8. The invention as defined in claim 7 further comprising:

p. a door guide in the form of a slot mounted upon the false door which is adjacent to said door head when the false door is closed, q. said door extending through said door guide.

9. The invention as defined in claim 8 further comprising:

r. said door elevators are in the form of cranks attached to a horizontal shaft upon the false door.

10. The invention as defined in claim 9 further comprising:

s. said elevator means being in the form of a hydraulic cylinder mounted upon the false door to rotate said shaft.

* * * * *